United States Patent [19]

Hutton

[11] Patent Number: 4,917,439

[45] Date of Patent: Apr. 17, 1990

[54] CHAIR INCORPORATING IMPROVED CHAIRBACK SUPPORT STRUCTURE

[75] Inventor: John A. Hutton, New York, N.Y.

[73] Assignee: Donghia Furniture Co., Ltd., New York, N.Y.

[21] Appl. No.: 200,648

[22] Filed: May 31, 1988

[51] Int. Cl.[4] ..... A47C 7/40

[52] U.S. Cl. ..... 297/443; 297/440

[58] Field of Search ..... 297/443, 440, 444, 445, 297/449, 450; 403/231

[56] References Cited

U.S. PATENT DOCUMENTS

| | | | |
|---|---|---|---|
| 396,963 | 1/1889 | Stone | 297/445 |
| 558,830 | 4/1896 | McCune | 297/444 |
| 1,449,473 | 3/1923 | Westbrook | 297/449 |
| 1,674,220 | 6/1928 | Percival | 297/440 |
| 1,718,321 | 6/1929 | Vericel | 297/444 |
| 2,467,664 | 4/1949 | Glenn | 297/443 |

*Primary Examiner*—Peter R. Brown
*Assistant Examiner*—Brian K. Green
*Attorney, Agent, or Firm*—Handal & Morofsky

[57] ABSTRACT

A chair of the four legged type with seat support rails, a seat and a back wherein rear legs, rear support rail and an inner rear support rail enclose the chair back providing strength and stability is disclosed.

4 Claims, 4 Drawing Sheets

CHAIR INCORPORATING IMPROVED CHAIRBACK SUPPORT STRUCTURE

TECHNICAL FIELD

The present invention relates to furniture construction, and, in particular, to a structure for supporting a back on a chair with a high degree of strength and means for distributing applied stresses throughout the structure.

BACKGROUND

Stools incorporating backs have been familiar pieces of furniture for millenia, examples having been found in, for example, the tombs of the Pharaohs. The problems attendant to achieving a stable chair structure, including, stable legs and a stable back support have been known for many years and numerous solutions have been proposed.

Typical of the solutions which have been employed over the years, is the inclusion of the back and the rear legs as a single unitary structure, which, after the traditional securing of the legs to the seat results in a stable and durable back support. Unfortunately, this type of construction is most often used in a chair in which the back is formed by a plurality of members, which is relatively uncomfortable. The comfort of such backs, which include so-called ladder-back and comb-back chairs, may be improved by the addition of upholstery, at additional cost.

Yet another approach is to provide a back which is supported by diagonal support elements which extend from the back of the seat to an extension on the rear of the back support. Here however the application of forces during sitting is concentrated at the points of support and the longevity of the structure is thus impaired.

Generally, pressure on the back portion, such as caused by a person leaning back, acts at the points of attachment focusing the stress forces at this point. The stressing will consist of various twisting forces or moments caused by the forces (pressure on the back portion) acting through distance (the distance from the position where the pressure is placed on the back portion to the points of attachment).

The forces acting forward-to-back, up-and-down and twisting may fatigue the structural elements at the points of attachment or may loosen or weaken the joint at the point of attachment. Fatigue, weakening and loosening will affect the integrity of the chair resulting in "give", wobbling or shakiness and possibly failure.

SUMMARY OF THE INVENTION

The invention addresses the problem of adequately securing a separate back piece to the rest of a chair to provide strength and stability.

By sandwiching the base of the back section to be mounted on the chair between the back support rail and an inner back support rail there is provided a planar surface of contact over which the forces attendant the joint may be spread.

The attachment of the back support rail and the inner back support rail to the rear legs further spreads the forces as does the use of corner blocks that are secured to the inner back support and the side rails.

The placement of the back at an angle greater than 90° from the plane of the seat also helps spread the tension on the front face of the seat at and above the joining line.

The result is a back with a greater effective thickness that is less prone to fatigue and a stronger joint.

BRIEF DESCRIPTION OF THE DRAWINGS

One way of carrying out the invention is described in detail below with reference to drawings which illustrate only one specific embodiment of the invention and in which.

BEST MODE FOR CARRYING OUT THE INVENTION

Figure 1:
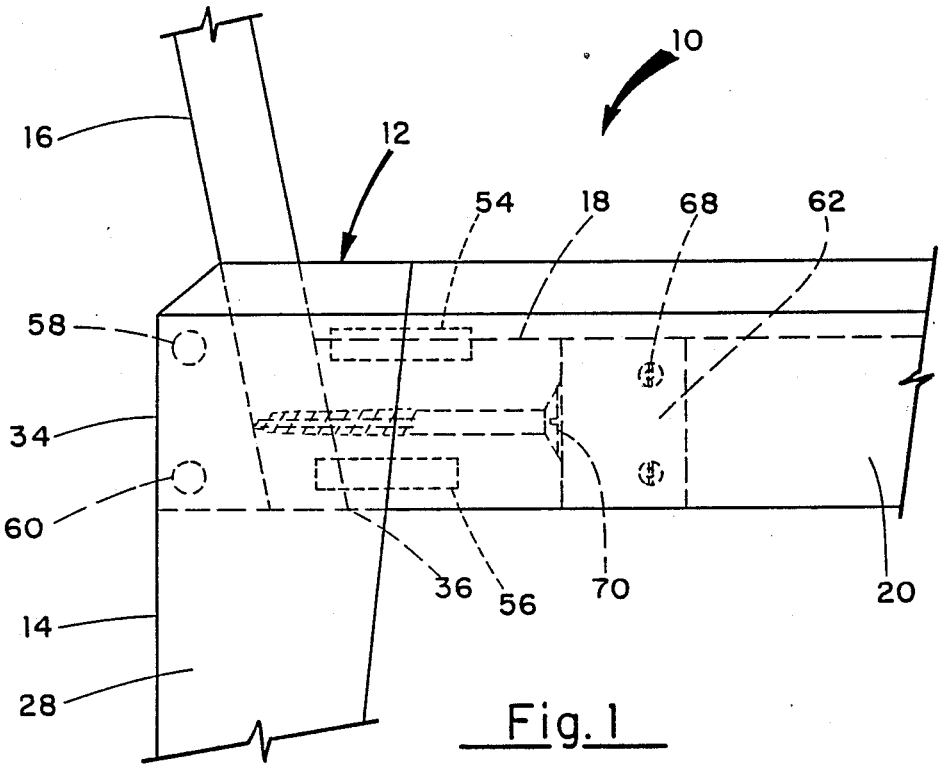
FIG. 1 is a right side elevational view of the right rear portion of a chair with the seat cushion removed, illustrating the joinery of the present invention.
Figure 3:
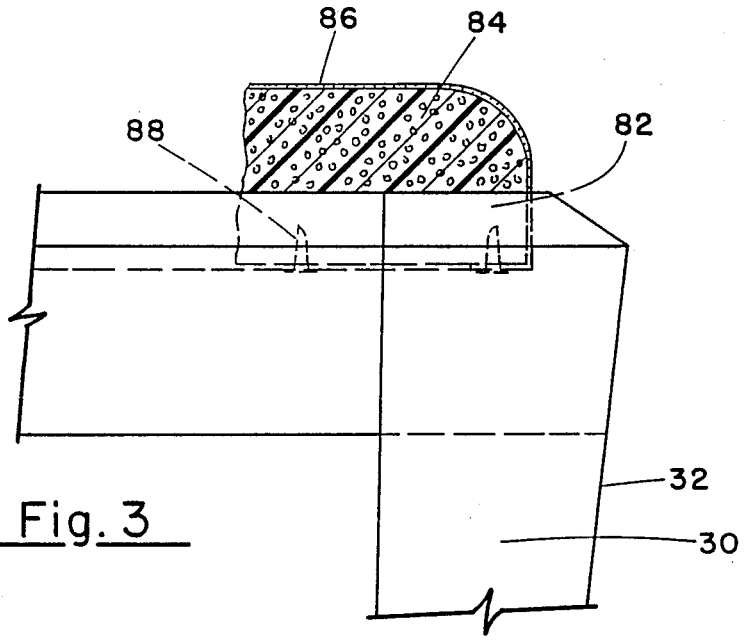
FIG. 3 is a right side view of a portion of a chair illustrating the cushion construction and the front legs thereof.

Referring to FIG. 1, a portion of a chair 10 incorporating the inventive joint 12 is illustrated. Chair 10 generally includes a right rear leg 14 having an upper and a lower portions, a back 16 and a cushion support 18. Cushion support 18 is formed by right side rail 20, a back brace 22 (FIG. 2), a left side rail 24 and a front rail 26 (FIG. 3). Back brace 22 further comprises a thick main body portion 21 and thin extensions 23. Chair 10 also comprises left rear leg 28, right front leg 30 and left front leg 32. Left rear leg 28 also having upper and lower portions and left front leg 32 are hidden from view behind right rear leg 14 and right front leg 30, respectively.

Figure 2:
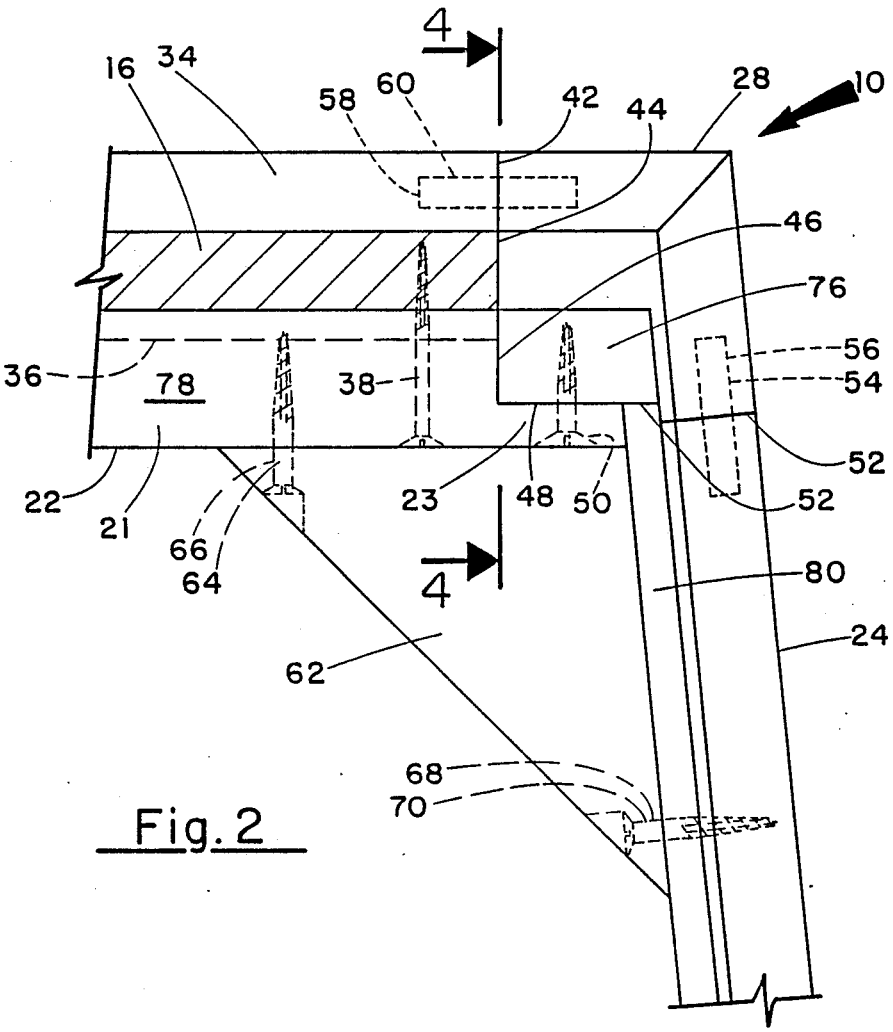
FIG. 2 is a top plan view of the joint with the seat cushion removed, partially in cross section and on the left side of the inventive chair.

Referring to FIG. 2, the structure of the inventive chair back construction is illustrated. Generally, the back is sandwiched between back brace 22 and a back rail 34. As can be seen from FIG. 1, the lower corner 36 of back 16 is positioned somewhat forward of the back edge of the seat, because back 16 is oriented at an angle, as illustrated most clearly in FIG. 1. The sandwich of back rail 34, back 16 and back brace 22 is maintained as a single integral unit by glue disposed between back brace 22 and back 16 as well as by a layer of glue between back 16 and back rail 34. Further support is provided by screws 38 and 40, which are located respectively at the left and right ends of the back. In addition, another wood screw may be provided centrally disposed between screws 38 and 40 and securing the back brace to the back.

Referring to FIG. 2, leg 28 is glued along surfaces 42, 44, 46 and 48 to the edges of the back rail, back and back brace. Generally, all abutting surfaces of the various chair frame elements are glued to each other. Additional strength is provided by screw 50 on the left. It is noted that the right and left back supporting structure are essentially mirror images of each other, including the same parts and the same use of glue to maintain the integrity of the structure. Side rail 24 is also secured to the leg by the application of glue to surfaces 52. Finally, the back leg support is completed by two pairs of dowels, namely, dowels 54 and 56 which join side rail 24 to leg 28 and dowels 58 and 60 which join back rail 34 to leg 28. It is noted that dowels 56 and 60 are not visible as they are hidden behind dowels 54 and 58, respectively in FIG. 2. In the illustration of the right joint structure shown in FIG. 1, corresponding structural members are marked with a prime symbol. The overall structure is then reinforced by a corner block 62, which is secured to back brace 22 by a pair of screws 64 and 66. Corner block 62 is secured to side rail 24 by screws 68 and 70. It is noted that screws 66 and 70 are hidden behind screws 64 and 68 in FIG. 2 and are thus not visible.

Figure 4:
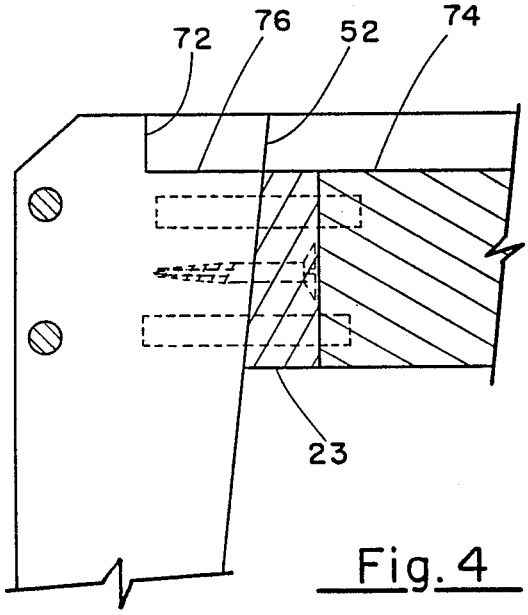
FIG. 4 is a view along lines 4—4 of FIG. 2 illustrating the seat supporting recess structure of the legs and side rails.

As shown in FIG. 4, a recess is defined by recess side edge 72 and a recess bottom edge 74 and provides a support for a conventional cushion comprising a wood frame which supports an appropriate upholstery filler material, which upholstery material together with the wood frame is covered by a suitable upholstery fabric, as will be discussed below. As can be seen in FIG. 2, a flat 76 is cut away from the top portion of leg 28. Flat 76 is level with the top surface 78 of back brace 22 and the top surface 80 of the recess cut into side rail 24. It is noted that in FIG. 2 surface 52 appears to be discontinuous but this apparent discontinuity is merely a result of the cut away recess and the tapered shape of leg 28.

Referring to FIG. 3, the construction of a typical seat cushion is illustrated. In particular, the seat cushion includes a wooden frame 82 which serves to support an upholstery filler material 84, such as polyurethane foam fiber or the like. The structure is covered in a conventional matter with an upholstery fabric 86, which is secured by nails 88 to the frame 82.

As can be seen from the above description, the combination of back brace 22, the legs and back rail 34 effectively form a box secured by glue, dowels and screws. In particular dowels 58–60 and screw 50 form a box which securely engages back 16. As can be seen from FIG. 1, this box is secured to and integral with the legs of the chair. Thus a secure structure is provided.

During use, if a person was to sit in the chair and lean against the back, the forces applied to the back would be distributed throughout the entire length of the box and, accordingly, all of the joints of the box would share the force. This would be in contrast to other structures such as the ladder back chair where the forces would be concentrated at a limited number of points which would be subjected to much greater stresses. The inventive structure also has the effect of creating a chair back with a large planar area which can be decorated with a wide variety of designs. In addition, it is noted that the construction is relatively inexpensive insofar as the back may consist of, for example, plywood or even a synthetic material.

It is noted that, in accordance with the present invention, all doweling will be made of wood. Likewise, all of the elements of the chair are also made of solid wood with the exception of the chair back which is, in accordance with the preferred embodiment, made of plywood.

While an illustrative embodiment of the invention has been described above, it is, of course, understood that various modifications will be apparent to those of ordinary skill in the art. Such modifications are within the spirit and scope of the invention, which is limited and defined only by the appended claims.

I claim:

1. A chair of a type having four legs, a seat and a back, comprising:

(a) a pair of rear support legs having upper and lower portions;

(b) a rear outer support rail secured between the upper portions of said legs;

(c) an inner support rail extending between said rear support legs and in facing spaced relationship to said rear outer support rail;

(d) a chair back sandwiched between said inner support rail and said rear outer support rail and secured therebetween, said outer support rail extending in a first direction between said rear support legs and being secured by pegs which extend in substantially said first direction and into holes defined in said rear support legs and said rear outer support rail;

(e) screws for securing said inner support rail to said back, said inner support rail bearing against and supporting said back and bearing against said pair of rear support legs; and (f) a recess support surface being formed in a pair of side rails each of which is secured to a respective one of said rear legs, said side rails defining right and left edges of the chair and a recess being further defined in that portion of said rear legs adjacent the recesses in adjacent side rails, said recess on said rear legs and said recesses on said side rails together providing substantially level support surfaces with a top facing surface of said inner support rail to support a seat cushion.

2. A chair as in claim 1, further comprising corner block support means secured by respective screws passing through said support means to said inner support rail and said side rails, a top surface of each of said corner block support means being substantially level with the recess surfaces defined by the legs and the side rails, and the top surface of said inner support rail.

3. A chair of a type having four legs, four outer support rails, a seat and a back, comprising:

(a) a pair of rear support legs having upper and lower portions;

(b) a rear outer support rail secured between the upper portions of said legs;

(c) an inner support rail extending between said rear support legs and in facing spaced relationship to said rear outer support rail;

(d) a chair back sandwiched between said inner support rail and said rear outer support rail and secured therebetween, said outer support rail extending in a first direction between said rear support legs and being secured by pegs which extend in substantially said first direction and into holes defined in said rear support legs and said rear outer support rail and wherein said inner support rail is secured by a pair of screws to said pair of rear support legs;

(e) securing members for securing said inner support rail to said back, said inner support rail comprising a main body of a first thickness which bears against and supports said back and an extension at opposite ends of the length of said main body, said extension having a second thickness, said second thickness being smaller than said first thickness, said securing member securing said inner support rail to said leg passing through said thinner extension, said extension bearing against said pair of rear support legs; and (f) a recess support surface being formed in a pair of side rails each of which is secured to a respective one of said rear legs, said side rails defining right and left edges of the chair and a recess being further defined in that portion of said rear legs adjacent the recesses in adjacent side rails, said recess on said rear legs and said recesses on said side rails together providing a substantially level support surface with a top facing surface of said inner support rail to support a seat cushion.

4. A chair of a type having four legs, a rear outer support rail, three other outer support rails, a seat and a back, comprising:

(a) a pair of rear support legs having upper and lower portions;

(b) a rear outer support rail secured between the upper portions of said rear legs;

(c) an inner support rail secured between said rear support legs and in facing spaced relationship to said rear outer support rail;

(d) a chair back sandwiched between said inner support rail and said rear outer support rail and secured therebetween, said rear outer support rails and said three other outer support rails extending in respective directions between respective pairs of said four legs and being secured to their respective legs and wherein said inner support rail is secured by a pair of screws to said pair of rear support legs;

(e) a pair of screws securing said inner support rail to said back, said inner support rail comprising a main body of a first thickness which bears against and supports said back and an extension at opposite ends of the length of said main body, said extension having a second thickness, said second thickness being smaller than said first thickness, said screws securing said inner support rail to said legs and passing through said thinner extension, said extension bearing against said pair of rear support legs; and (f) a recess support surface being formed in said outer support rails, and a recess being further defined in that portion of said four legs adjacent the recesses in adjacent outer support rails, said recesses on said rear legs and said recesses on said outer support rails together providing a substantially level support surface with a top facing surface of said inner support rail to support a seat cushion.

* * * * *